US012416433B1

(12) United States Patent
Chen

(10) Patent No.: US 12,416,433 B1
(45) Date of Patent: Sep. 16, 2025

(54) REFRIGERATION FAN WITH LATERAL HEAT DISSIPATION

(71) Applicant: Shenzhen Weiteshijia Technology Co., Ltd, Shenzhen (CN)

(72) Inventor: Yan Chen, Huilai (CN)

(73) Assignee: Shenzhen Weiteshijia Technology Co., Ltd, Shenzhen (CN)

( * ) Notice: Subject to any disclaimer, the term of this patent is extended or adjusted under 35 U.S.C. 154(b) by 0 days.

(21) Appl. No.: 19/223,093

(22) Filed: May 30, 2025

(30) Foreign Application Priority Data

Apr. 11, 2025 (CN) ..... 202520680070.X

(51) Int. Cl.
*F25B 21/02* (2006.01)
*F25D 17/04* (2006.01)

(52) U.S. Cl.
CPC ..... *F25B 21/02* (2013.01); *F25D 17/04* (2013.01)

(58) Field of Classification Search
CPC ..... F25D 17/04; F25B 2600/112; F25B 21/02
See application file for complete search history.

(56) References Cited

U.S. PATENT DOCUMENTS 2,750,167 A * 6/1956 Gregg ..... F24F 5/0035 261/24
6,525,934 B1 * 2/2003 Nakanishi ..... H01L 23/38 174/16.3
7,926,198 B2 * 4/2011 Merritt ..... A45D 20/30 34/283
10,299,560 B1 * 5/2019 Nelson ..... A45D 20/12
11,079,123 B1 * 8/2021 Nelson ..... F25D 3/08
12,203,679 B1 * 1/2025 Nelson ..... F25D 3/08
2006/0248917 A1 * 11/2006 Urfig ..... F24F 5/0017 62/425
2011/0272054 A1 * 11/2011 Yang ..... F24T 10/15 138/149
2015/0075184 A1 * 3/2015 Edwards ..... F28D 15/06 62/3.2
2016/0178293 A1 * 6/2016 Pérez López ..... F28F 13/06 29/428
2018/0164020 A1 6/2018 Gary et al.
2021/0041157 A1 2/2021 Gary et al.
2024/0068733 A1 2/2024 Gary et al.

* cited by examiner

*Primary Examiner* — Filip Zec

(74) *Attorney, Agent, or Firm* — Hemisphere Law, PLLC; Zhigang Ma

(57) ABSTRACT

A refrigeration fan with lateral heat dissipation is provided, including a fan head and a hand-held handle. A conductive sheet is laid on an outer surface of the hand-held handle, a cavity is arranged in the hand-held handle, and a cold-heat generation apparatus is mounted in the cavity. The hand-held handle is provided with an air inlet and an air outlet, a refrigeration end of the cold-heat generation apparatus is connected to the conductive sheet in a heat conduction manner, and a heat dissipation end of the cold-heat generation apparatus communicates with the air outlet.

7 Claims, 8 Drawing Sheets

REFRIGERATION FAN WITH LATERAL HEAT DISSIPATION

TECHNICAL FIELD

The present disclosure relates to the technical field of fans, and in particular to a refrigeration fan with lateral heat dissipation.

BACKGROUND

Fan is a common household appliance in daily life, which is used to cool the air in hot weather, and is widely used due to its practical function, so it has a strong market demand.

Hand-held fan refers to a small fan with a hand-held handle on a fan body. When in use, the fan can be carried around by holding its hand-held handle, and the fan is favored by consumers due to its good portability.

However, after using the hand-held fan for a long time, the consumers often have a hot and moist palm. This poor physiological sensation not only affects usage experience of consumers, but also reduces the cooling effect of the fan. Because the palm of the human body is a part sensitive to temperature perception, its perceived information is about to affect the perception and judgment of the human body after being amplified by cranial nerve. If the palm perceives a stuffy heat, the subconscious mind tends to believe that it is currently in a muggy environment, and when the palm perceives cool, the subconscious mind tends to believe that it is currently in a cool environment. Therefore, how to improve the poor physiological sensation formed after holding the hand-held fan for a long time is particularly important for improving usage effect of the hand-held fan.

SUMMARY

An objective of the present disclosure is to provide a refrigeration fan with lateral heat dissipation. A conductive sheet is arranged on an outer surface of a hand-held handle of a hand-held fan, and a refrigeration effect can be achieved by the conductive sheet through an operation of a cold-heat generation apparatus. When a consumer holds and uses the fan, instead of forming a stuffy feeling, a cooling effect of the fan can be improved through palm refrigeration, thereby solving the problems in the background.

To achieve the objective above, the present disclosure provides the following technical solution: a refrigeration fan with lateral heat dissipation includes a fan head and a hand-held handle. The hand-held handle is circumferentially formed by enclosing a first side surface, a second side surface, a third side surface and a fourth side surface. The first side surface is arranged on a side of an air outlet direction of the fan head, the third side surface is opposite to the first side surface, and the second side surface and the fourth side surface are arranged on a left side and a right side of the first side surface, respectively. A conductive sheet is laid on an outer surface of the hand-held handle, a cavity is arranged in the hand-held handle, and a cold-heat generation apparatus is mounted in the cavity. The hand-held handle is provided with an air inlet and an air outlet, a refrigeration end of the cold-heat generation apparatus is connected to the conductive sheet in a heat conduction manner, a heat dissipation end of the cold-heat generation apparatus communicates with the air outlet to dissipate heat outward through the air outlet, the air outlet is formed on the second side surface, and/or the fourth side surface. The hand-held handle is equally divided into five segments from one end close to the fan head to one end away from the fan head in a length direction, the air outlet is arranged at one end, close to the fan head, of the hand-held handle, and is arranged in an area where a first segment and/or a second segment are/is located.

Preferably, the air inlet is formed on the second side surface, and/or the fourth side surface. The cold-heat generation apparatus includes an air guide cover, an air-driving blade group, a heat sink and a semiconductor refrigeration sheet. The air guide cove is provided with a first vent hole, the first vent hole communicates with the air inlet, the air-driving blade group is mounted in the air guide cover, and the heat sink is arranged at one side, away from the first vent hole, of the air-driving blade group. The heat sink is provided with a second vent hole, and the second vent hole communicates with the air outlet. A heating end of the semiconductor refrigeration sheet is connected to the heat sink in a heat conduction manner, and a refrigeration end of the semiconductor refrigeration sheet is connected to the conductive sheet in a heat conduction manner.

Preferably, the air inlet is formed on the third side surface. The cold-heat generation apparatus includes a semiconductor refrigeration sheet, a heat sink, and an air-driving blade group. A refrigeration end of the semiconductor refrigeration sheet is connected to the conductive sheet in a heat conduction manner, and a heating end of the semiconductor refrigeration sheet is connected to the heat sink in a heat conduction manner. The air-driving blade group is disposed on one side, away from the semiconductor refrigeration sheet, of the heat sink, the heat sink is provided with a second vent hole, and the second vent hole communicates with the air outlet. The air-driving blade group is configured to guide air at the air inlet to be blown outward from the air outlet after passing through the heat sink and the second vent hole.

Preferably, the semiconductor refrigeration sheet is circumferentially surrounded with an isolation frame, a cavity opening of the cavity is covered with a cavity cover plate, and the air inlet is formed on the cavity cover plate.

Preferably, the conductive sheet extends in the length direction of the hand-held handle.

Preferably, the fan head is rotatably connected to the hand-held handle by a rotating mechanism. The rotating mechanism includes a rotating shaft integrally connected to the fan head, a shaft seat arranged on the hand-held handle, and a damping ring sandwiched between the rotating shaft and the shaft seat. The rotating shaft is inserted into the shaft seat and rotatably connected to the shaft seat.

Preferably, the hand-held handle includes a handle front housing and a handle rear housing engaged with each other, a circuit board assembly and a storage battery are arranged between the handle front housing and the handle rear housing, the storage battery is electrically connected to the circuit board assembly, a control key and an USB (Universal serial bus) interface are electrically connected to the circuit board assembly, and the control key and the USB interface are both arranged in a preset through hole of a housing of the hand-held handle and extend outward from the through hole.

Compared with the prior art, the present disclosure has beneficial effects as follows:

according to the present disclosure, a conductive sheet is arranged on an outer surface of a hand-held handle of a hand-held fan, and a refrigeration effect can be achieved by the conductive sheet through an operation of a cold-heat generation apparatus. When a consumer holds and uses the fan, instead of forming a stuffy feeling, a cooling effect of the fan can be improved through palm refrigeration, thereby solving the problems in the background.

IN THE DRAWINGS

1—fan head; 2—hand-held handle; 21—handle front housing; 22—handle rear housing; 23—air inlet; 24—air outlet; 25—circuit board assembly; 26—storage battery; 27—control key; 28—USB interface; 29—cavity cover plate; 31—air guide cover; 311—first vent hole; 32—air-driving blade group; 33—heat sink; 331—second vent hole; 34—semiconductor refrigeration sheet; 341—isolation frame; 4—conductive sheet; 51—rotating shaft; 52—shaft seat; 53—damping ring.

DETAILED DESCRIPTION OF THE EMBODIMENTS

The following clearly and completely describes the technical solutions in embodiments of the present disclosure with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the scope of protection of the present disclosure.

Figure 1:
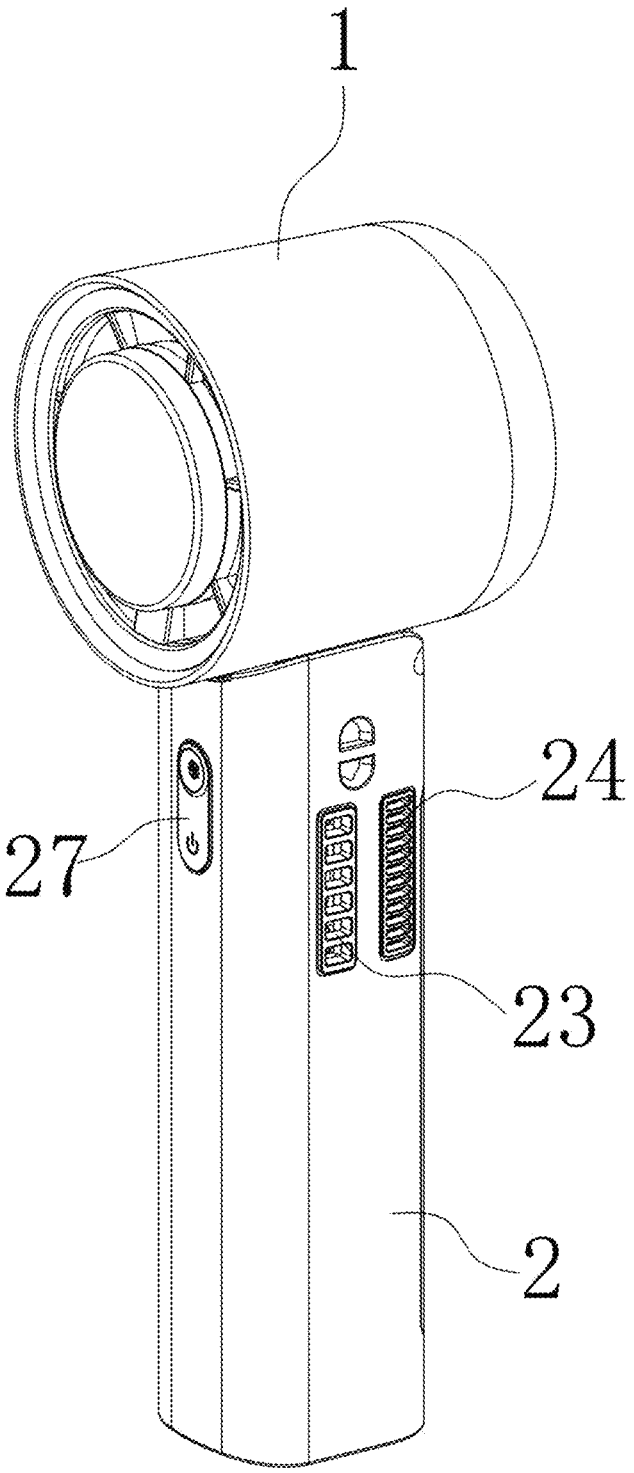
FIG. 1 is a first diagram of a structure according to embodiment 1 of the present disclosure.
Figure 2:
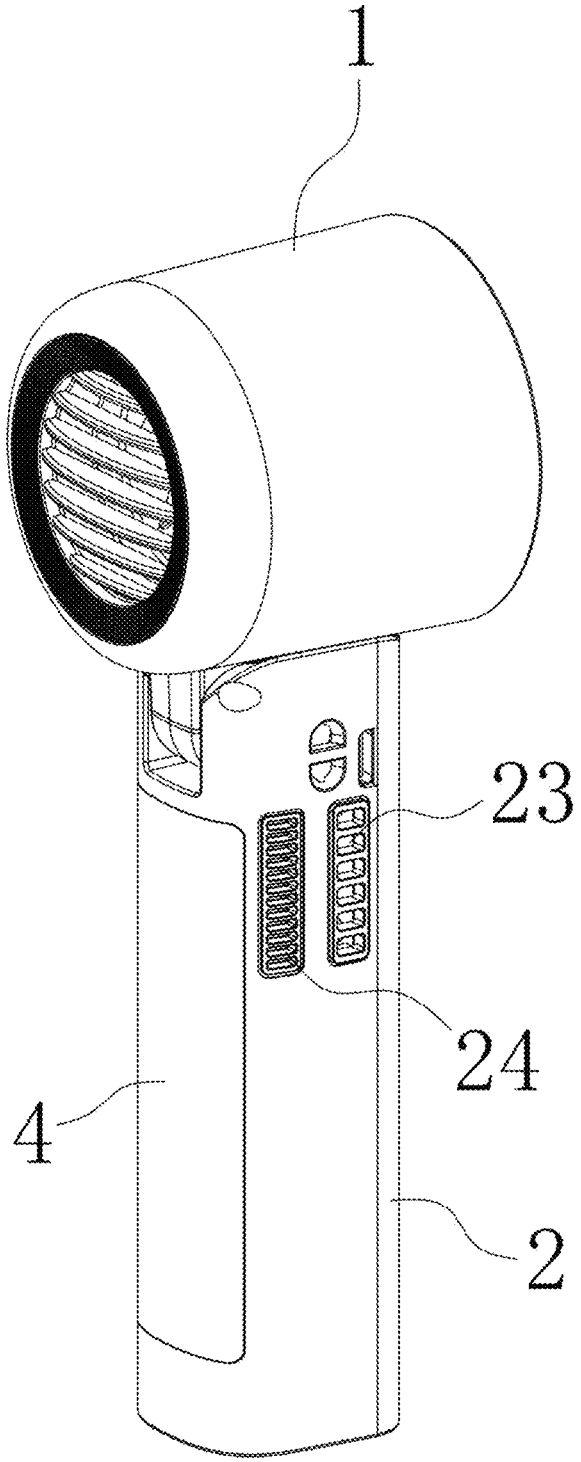
FIG. 2 is a second diagram of a structure according to embodiment 1 of the present disclosure.
Figure 3:
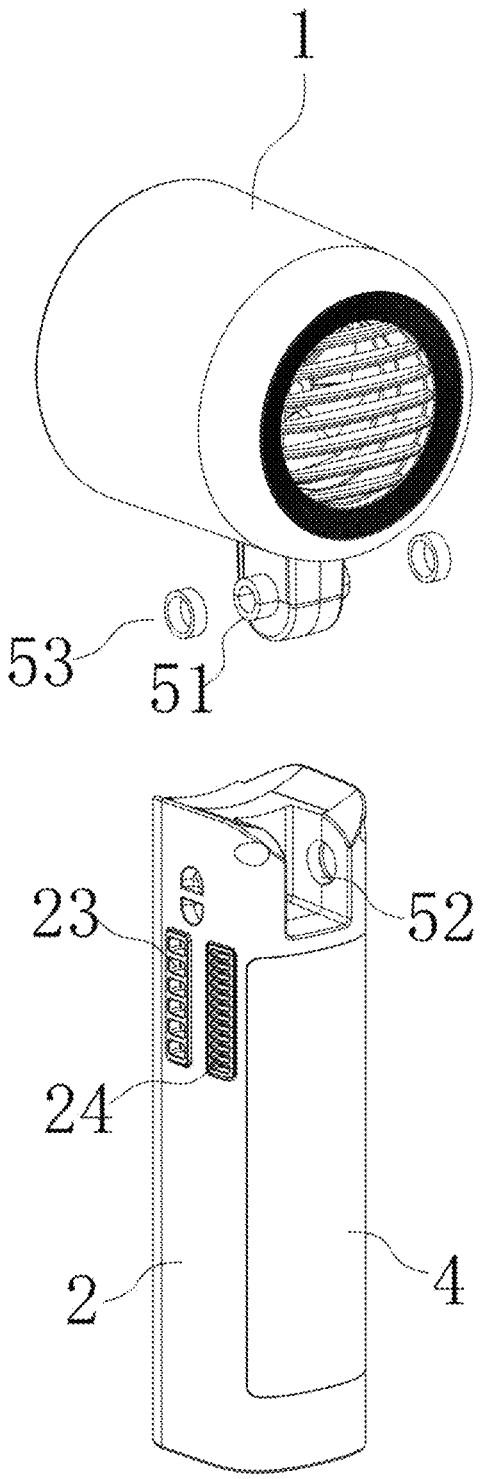
FIG. 3 is a third diagram of a structure according to embodiment 1 of the present disclosure.
Figure 4:
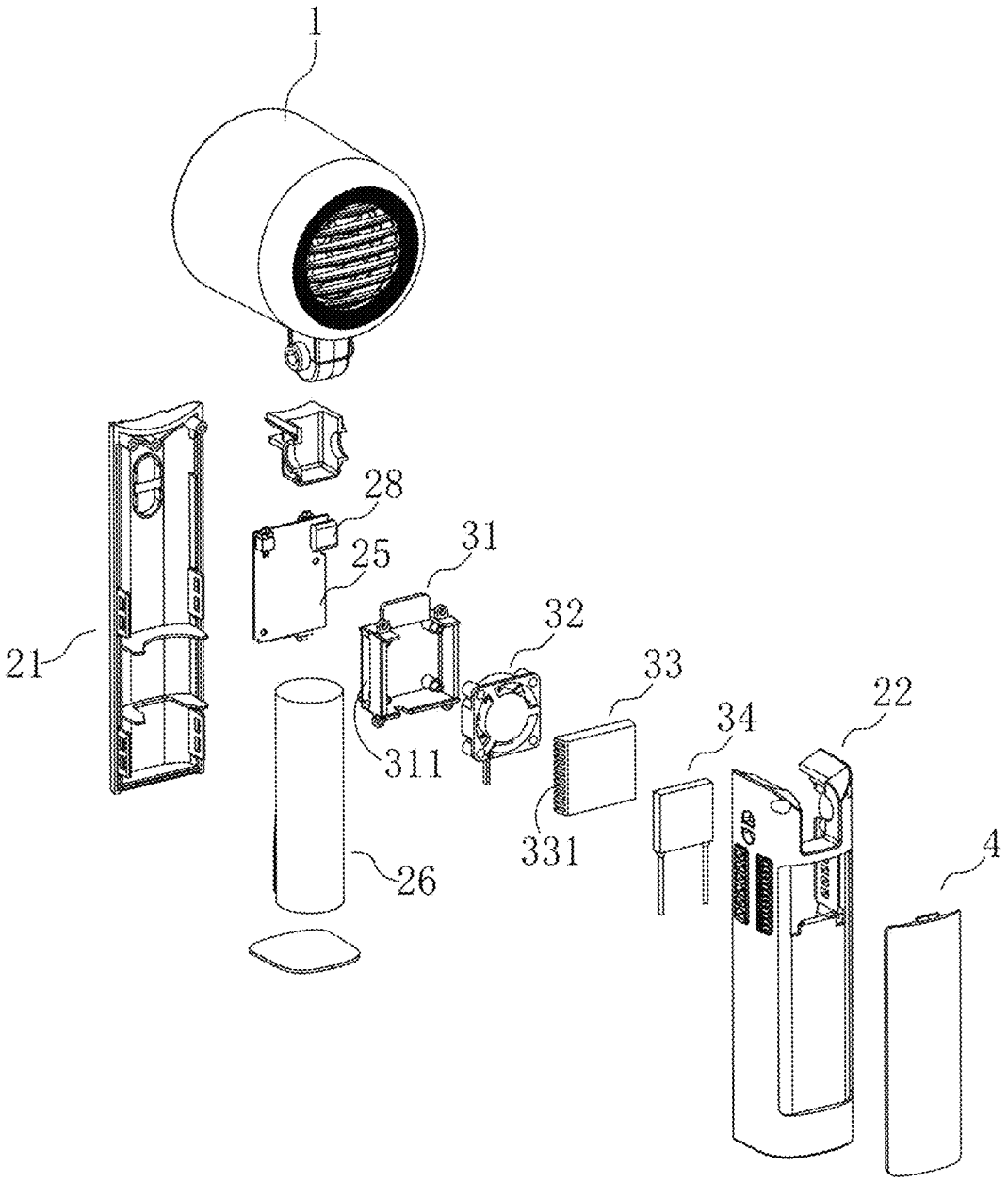
FIG. 4 is an exploded view of a structure according to embodiment 1 of the present disclosure.
Figure 5:
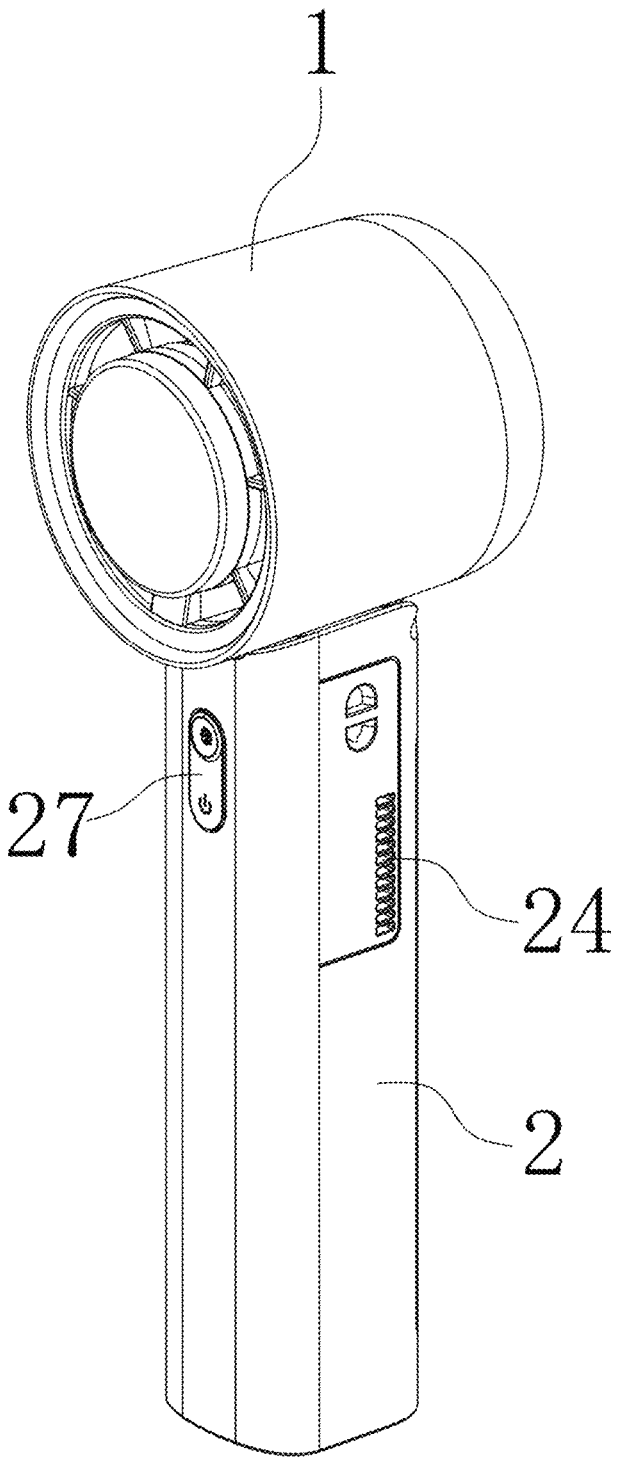
FIG. 5 is a first diagram of a structure according to embodiment 2 of the present disclosure.
Figure 6:
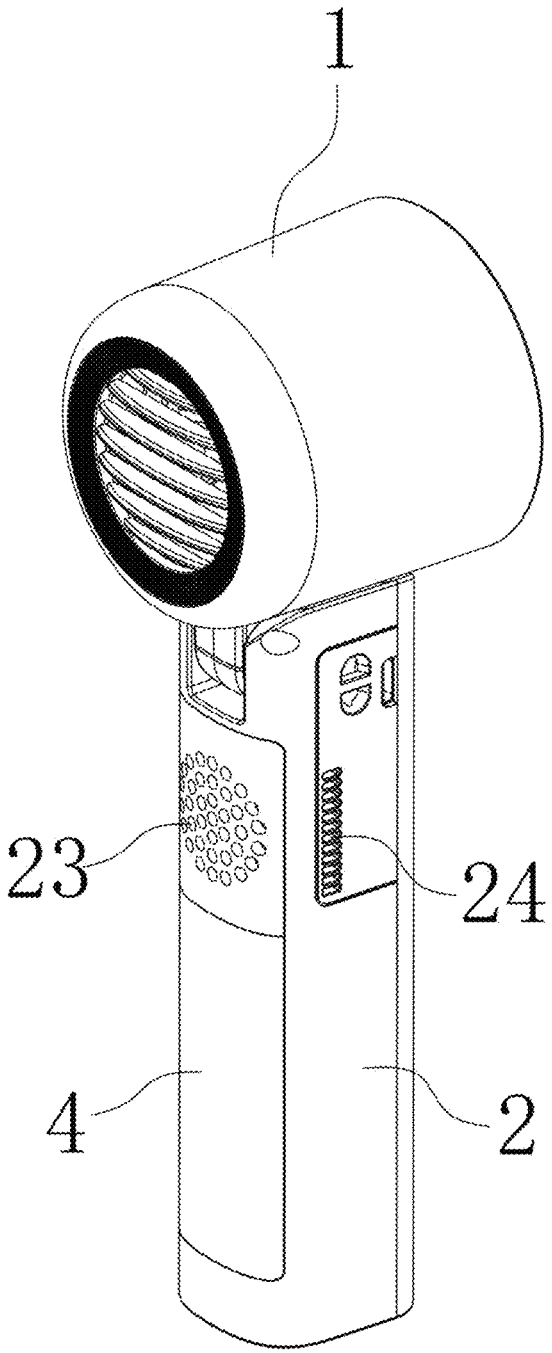
FIG. 6 is a second diagram of a structure according to embodiment 2 of the present disclosure.
Figure 7:
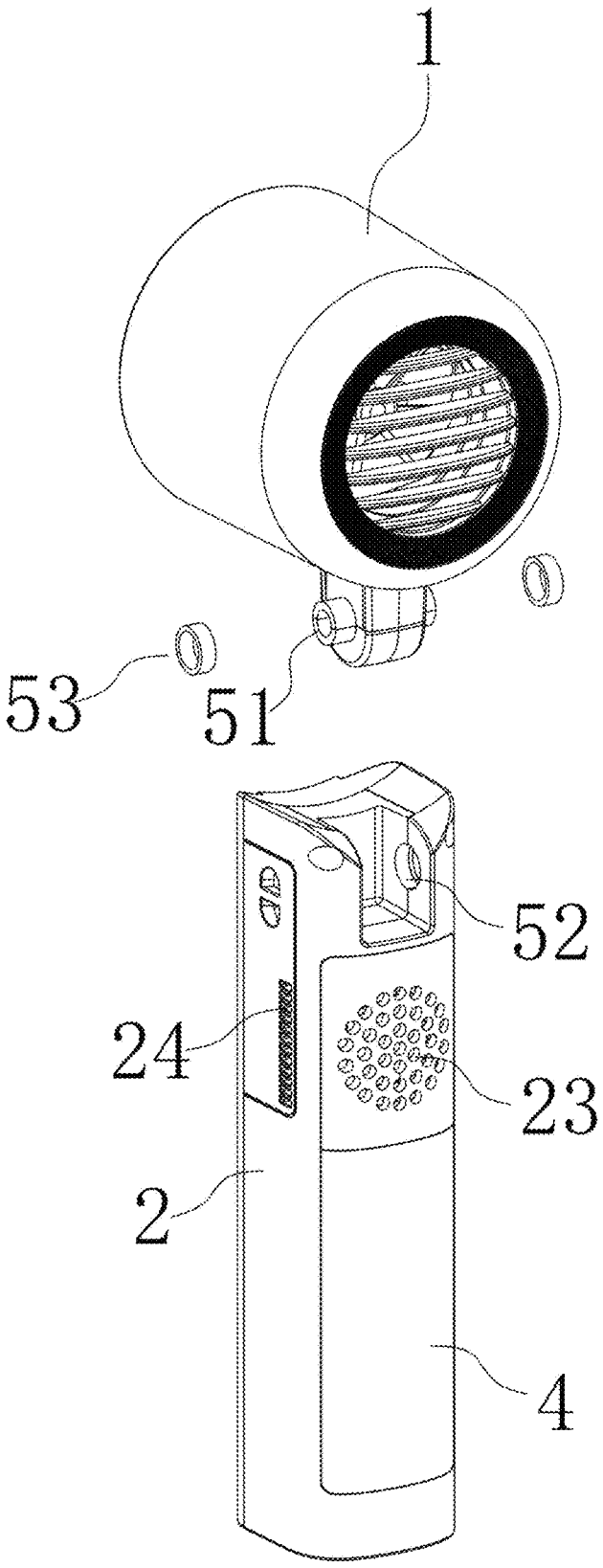
FIG. 7 is a third diagram of a structure according to embodiment 2 of the present disclosure.
Figure 8:
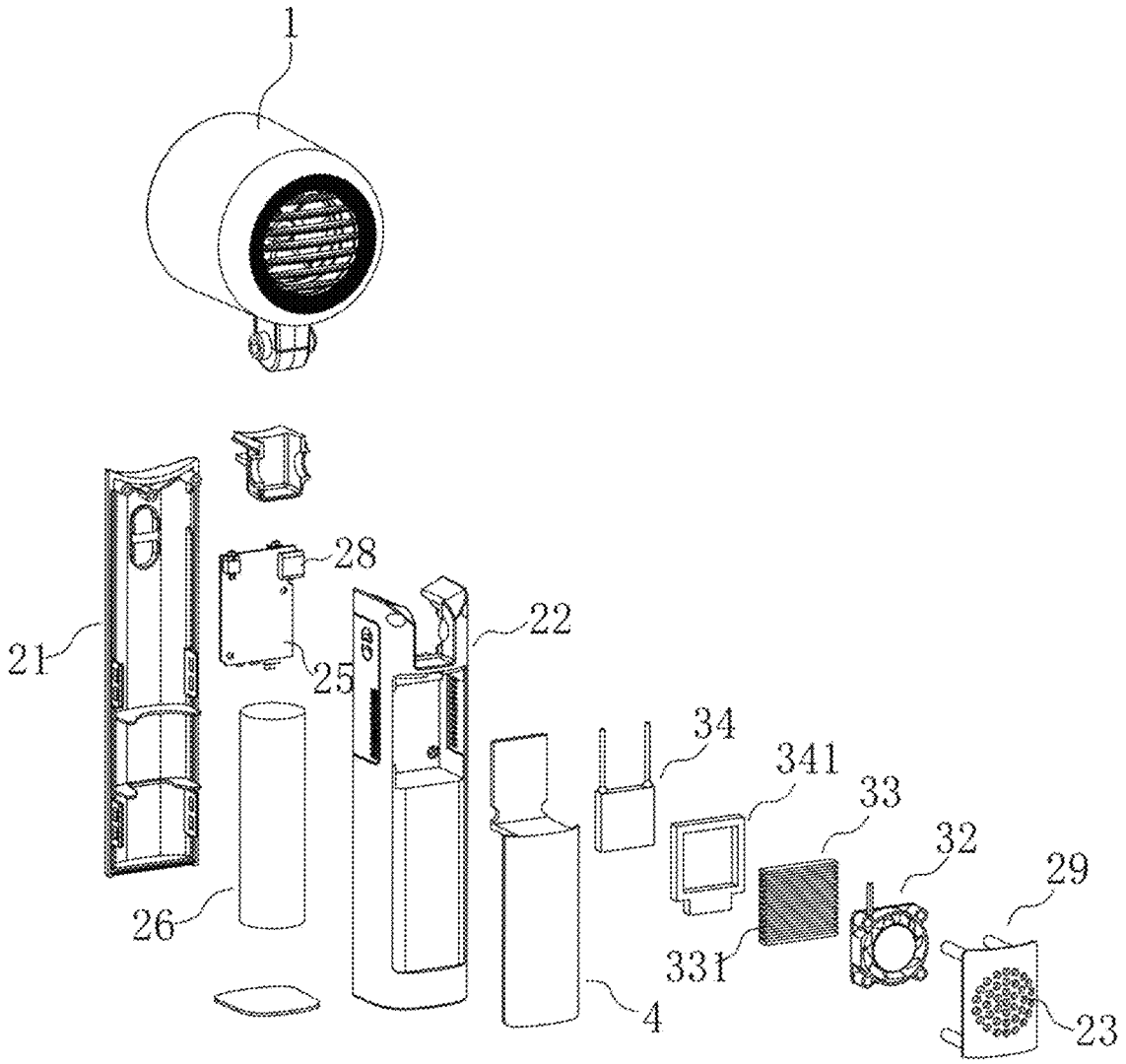
FIG. 8 is an exploded view of a structure of embodiment 2 of the present disclosure.

With reference to FIG. 1 to FIG. 8, a refrigeration fan with lateral heat dissipation includes a fan head 1 and a handheld fan 2. The hand-held handle 2 is circumferentially enclosed by a first side surface, a second side surface, a third side surface and a fourth side surface. The first side surface is arranged on a side of an air outlet direction of the fan head 1, the third side surface is opposite to the first side surface, and the second side surface and the fourth side surface are arranged on a left side and a right side of the first side surface, respectively. A conductive sheet 4 is laid on an outer surface of the hand-held handle 2, the conductive sheet 4 extends in a length direction of the hand-held handle 2, a cavity is arranged in the hand-held handle 2, and a cold-heat generation apparatus is mounted in the cavity. The hand-held handle 2 is provided with an air inlet 23 and an air outlet 24. A refrigeration end of the cold-heat generation apparatus is connected to the conductive sheet 4 in a heat conduction manner, a heat dissipation end of the cold-heat generation apparatus communicates with the air outlet 24 to dissipate heat outward through the air outlet 24. The air outlet 24 is formed on the second side surface, and/or the fourth side surface. When the air outlet 24 is formed on each of the two side surfaces, the air with temperature blown out from the air outlet 24 can be prevented from acting on the human body to form a poor touch, and it is also beneficial to prevent a heat dissipation airflow carrying heat from flowing back to enter an operating airflow of the fan head 1 to reduce a normal operating effect of the fan head 1. The hand-held handle 2 is equally divided into five segments from one end close to the fan head 1 to one end away from the fan head 1 in the length direction, and the air outlet 24 is arranged at one end, close to the fan head 1, of the hand-held handle 2, and is arranged in an area where the first segment and/or the second segment are/is located, thereby limiting the air outlet 24 between the first segment and the second segment at an upper end of the hand-held handle 2. A lower end of the hand-held handle 2 can be ensured to have an enough length for a hand to hold, a situation that a heat dissipation effect of the cold-heat generation apparatus is affected due to a phenomenon that the air outlet 24 is blocked in the process of holding the handle 2 with the hand because a reserved holding length of the handle 2 is too short is avoided.

There are two specific embodiments for describing a combination way of the cold-heat generation apparatus and the hand-held handle 2 in the present disclosure.

Embodiment 1: With reference to FIG. 1 to FIG. 4, the air inlet 23 is formed on the second side surface and/or the fourth side surface, the air inlet 23 is close to the air outlet 24, the cold-heat generation apparatus includes an air guide cover 31, an air-driving blade group 32, a heat sink 33, and a semiconductor refrigeration sheet 34. The air guide cover 31 is provided with a first vent hole 311, the first vent hole 311 communicates with the air inlet 23, the air-driving blade group 32 is mounted in the air guide cover 31, and the heat sink 33 is arranged at one side, away from the first vent hole 311, of the air-driving blade group 32. The heat sink 33 is provided with a second vent hole 331, the second vent hole 331 communicates with the air outlet 24, a heating end of the semiconductor refrigeration sheet 34 is connected to the heat sink 33 in a heat conduction manner, and a refrigeration end of the semiconductor refrigeration sheet 34 is connected to the conductive sheet 4 in a heat conduction manner. When the semiconductor refrigeration sheet 34 operates, the refrigeration end cools the conductive sheet 4 through the heat conduction manner, thereby enabling the conductive sheet 4 to achieve a refrigeration effect. In this case, according to a principle of energy equivalence exchange, the heating end of the semiconductor refrigeration sheet 34 generates heat, and the heat is conducted to the heat sink 33 and then diffused on the heat sink 33. Finally, an airflow formed by the air-driving blade group 32 takes the heat on the heat sink 33 out of a housing of the handle 2 from the air outlet 24 when passing through the heat sink 33, thereby achieving a heat dissipation effect.

Embodiment 2: With reference to FIG. 5 to FIG. 8, the air inlet 23 is formed on the third side surface, the cold-heat generation apparatus includes a semiconductor refrigeration sheet 34, a heat sink 33, and an air-driving blade group 32. A refrigeration end of the semiconductor refrigeration sheet 34 is connected to the conductive sheet 4 in a heat conduction manner, a heating end of the semiconductor refrigeration sheet 34 is connected to the heat sink 33 in a heat conduction manner, the air-driving blade group 32 is disposed on one side, away from the semiconductor refrigeration sheet 34, of the heat sink 33. The heat sink 33 is provided with a second vent hole 331, and the second vent hole 331 communicates with the air outlet 24. The air-driving blade group 32 is configured to guide air at the air inlet 23 to be blown outward from the air outlet 24 after passing through the heat sink 33 and the second vent hole 331. The semiconductor refrigeration sheet 34 is circumferentially surrounded with an isolation frame 341, the isolation frame 341 plays a role in assisting fixing the semiconductor refrigeration sheet 34, and has the heat insulation effect at the same time, so that there is no interference between the semiconductor refrigeration sheet 34 and the conductive sheet 4. A cavity opening of the cavity is covered with a cavity cover plate 29, and the air inlet 23 is formed on the cavity cover plate 29.

The fan head 1 is rotatably connected to the hand-held handle 2 by a rotating mechanism. The rotating mechanism includes a rotating shaft 51 integrally connected to the fan head 1, a shaft seat 52 arranged on the hand-held handle 2, and a damping ring 53 sandwiched between the rotating shaft 51 and the shaft seat 52. The rotating shaft 51 is inserted into the shaft seat 52 and rotatably connected to the shaft seat 52.

The hand-held handle 2 includes a handle front housing 21 and a handle rear housing 22 engaged with each other, a circuit board assembly 25 and a storage battery 26 are arranged between the handle front housing 21 and the handle rear housing 22, the storage battery 26 is electrically connected to the circuit board assembly 25, and a control key 27 and an USB interface 28 are electrically connected to the circuit board assembly 25. The control key 27 and the USB interface 28 are both arranged in a preset through hole of a housing of the hand-held handle and extend outward from the through hole. The control key 27 is configured to regulate and switch operating states and operating modes of the air-driving blade group 32 and the semiconductor refrigeration sheet 34. The USB interface can charge the storage battery 26 when connected to an external power supply through a charging cable.

In conclusion, the conductive sheet 4 is arranged on the outer surface of a hand-held handle 2 of the hand-held fan, and a refrigeration effect can be achieved by the conductive sheet 4 through an operation of a cold-heat generation apparatus. When a consumer holds and uses the fan, instead of forming a stuffy feeling, a cooling effect of the fan can be improved through palm refrigeration.

It should be noted that relational terms such as first and second herein are only used to distinguish one entity or operation from another entity or operation without necessarily requiring or implying any such actual relationship or order between these entities or operations. Moreover, the terms "including", "containing" or any other variation thereof are intended to cover non-exclusive inclusion, so that a process, method, commodity or device including a series of elements includes not only those elements, but also other elements not explicitly listed, or elements inherent to such a process, method, commodity or device.

Although the embodiments of the present disclosure have been shown and described, those skilled in the art should appreciate that many changes, modifications, substitutions and variations can be made to these embodiments without departing from the principles and spirits of the present disclosure, and the scope of the present disclosure is defined by the claims and their equivalents.

What is claimed is:

1. A refrigeration fan with lateral heat dissipation, comprising a fan head (1) and a hand-held handle (2), wherein the hand-held handle (2) is circumferentially formed by enclosing a first side surface, a second side surface, a third side surface and a fourth side surface, the first side surface is arranged on a side of an air outlet direction of the fan head (1), the third side surface is opposite to the first side surface, and the second side surface and the fourth side surface are arranged on a left side and a right side of the first side surface, respectively; a conductive sheet (4) is laid on an outer surface of the hand-held handle (2), a cavity is arranged in the hand-held handle (2), and a cold-heat generation apparatus is mounted in the cavity; the hand-held handle (2) is provided with an air inlet (23) and an air outlet (24), a refrigeration end of the cold-heat generation apparatus is connected to the conductive sheet (4) in a heat conduction manner, a heat dissipation end of the cold-heat generation apparatus communicates with the air outlet (24) to dissipate heat outward through the air outlet (24), and the air outlet (24) is formed on the second side surface, and/or the fourth side surface; the hand-held handle (2) is equally divided into five segments from one end close to the fan head (1) to one end away from the fan head (1) in a length direction, the air outlet (24) is arranged at one end, close to the fan head (1), of the hand-held handle (2), and is arranged in an area where a first segment and/or a second segment are/is located.

2. The refrigeration fan with lateral heat dissipation according to claim 1, wherein the air inlet (23) is formed on the second side surface, and/or the fourth side surface, the cold-heat generation apparatus comprises an air guide cover (31), an air-driving blade group (32), a heat sink (33) and a semiconductor refrigeration sheet (34); the air guide cove (31) is provided with a first vent hole (311), the first vent hole (311) communicates with the air inlet (23), the air-driving blade group (32) is mounted in the air guide cover (31), and the heat sink (33) is arranged at one side, away from the first vent hole (311), of the air-driving blade group (32); the heat sink (33) is provided with a second vent hole (331), and the second vent hole (331) communicates with the air outlet (24); and a heating end of the semiconductor refrigeration sheet (34) is connected to the heat sink (33) in a heat conduction manner, and a refrigeration end of the semiconductor refrigeration sheet (34) is connected to the conductive sheet (4) in a heat conduction manner.

3. The refrigeration fan with lateral heat dissipation according to claim 1, wherein the air inlet (23) is formed on the third side surface, the cold-heat generation apparatus comprises a semiconductor refrigeration sheet (34), a heat sink (33), and an air-driving blade group (32); a refrigeration end of the semiconductor refrigeration sheet (34) is connected to the conductive sheet (4) in a heat conduction manner, and a heating end of the semiconductor refrigeration sheet (34) is connected to the heat sink (33) in a heat conduction manner; the air-driving blade group (32) is disposed on one side, away from the semiconductor refrigeration sheet (34), of the heat sink (33), the heat sink (33) is provided with a second vent hole (331), and the second vent hole (331) communicates with the air outlet (24); and the air-driving blade group (32) is configured to guide air at the air inlet to be blown outward from the air outlet (24) after passing through the heat sink (33) and the second vent hole (331).

4. The refrigeration fan with lateral heat dissipation according to claim 3, wherein the semiconductor refrigeration sheet (34) is circumferentially surrounded with an isolation frame (341), a cavity opening of the cavity is covered with a cavity cover plate (29), and the air inlet (23) is formed on the cavity cover plate (29).

5. The refrigeration fan with lateral heat dissipation according to claim 1, wherein the conductive sheet (4) extends in the length direction of the hand-held handle (2).

6. The refrigeration fan with lateral heat dissipation according to claim 1, wherein the fan head (1) is rotatably connected to the hand-held handle (2) by a rotating mechanism, the rotating mechanism comprises a rotating shaft (51) integrally connected to the fan head (1), a shaft seat (52) arranged on the hand-held handle (2), and a damping ring (53) sandwiched between the rotating shaft (51) and the shaft seat (52); and the rotating shaft (51) is inserted into the shaft seat (52) and rotatably connected to the shaft seat (52).

7. The refrigeration fan with lateral heat dissipation according to claim 1, wherein the hand-held handle (2) comprises a handle front housing (21) and a handle rear housing (22) engaged with each other, a circuit board assembly (25) and a storage battery (26) are arranged between the handle front housing (21) and the handle rear housing (22), the storage battery (26) is electrically connected to the circuit board assembly (25), a control key (27) and an USB (Universal serial bus) interface (28) are electrically connected to the circuit board assembly (25), and the control key (27) and the USB interface (28) are both arranged in a preset through hole of a housing of the hand-held handle and extend outward from the through hole.

* * * * *